United States Patent [19]

Kostek et al.

[11] Patent Number: 4,470,776

[45] Date of Patent: Sep. 11, 1984

[54] METHODS AND APPARATUS FOR GEAR PUMP LUBRICATION

[75] Inventors: Theodore P. Kostek; David W. Francis, both of Youngstown, Ohio

[73] Assignee: Commercial Shearing, Inc., Youngstown, Ohio

[21] Appl. No.: 98,232

[22] Filed: Nov. 28, 1979

[51] Int. Cl.[3] ..... F04C 2/18; F04C 15/00

[52] U.S. Cl. ..... 418/1; 418/75; 418/102; 418/132

[58] Field of Search ..... 418/1, 102, 131, 132, 418/75, 78, 79

[56] References Cited

U.S. PATENT DOCUMENTS

| | | | |
|---|---|---|---|
| 2,276,107 | 3/1942 | Simons | 418/102 |
| 3,156,191 | 11/1964 | Lauck | 418/102 |
| 3,490,382 | 1/1970 | Joyner | 418/102 |
| 4,265,602 | 5/1981 | Teruyama | 418/1 |

FOREIGN PATENT DOCUMENTS

| | | | |
|---|---|---|---|
| 1182608 | 2/1970 | United Kingdom | 418/102 |

*Primary Examiner*—John J. Vrablik

*Attorney, Agent, or Firm*—Buell, Blenko, Ziesenheim & Beck

[57] ABSTRACT

A gear pump structure is provided having a housing with a pump chamber, a suction chamber and a discharge chamber communicating with said pump chamber on opposite sides thereof, a suction port and a discharge port in said housing communicating respectively with the suction chamber and discharge chamber, each of said ports have spaced apart inlet and outlet means, said suction port being contoured to provide on introduction of fluid into the inlet end a point intermediate its inlet and outlet means having a pressure higher than the pressure at the inlet and outlet means, at least one pair of meshing gears mounted for rotation in said pump chamber and each having two axially spaced trunnions, a plurality of bearing means in said housing each having an axial bore mounting said trunnions for rotation in the pump chamber, drive means for rotating said gears so that liquid which is drawn through the suction port into the suction chamber is engaged by teeth on said gears and transferred to the discharge port under pressure, fluid passage means connecting the ends of said bearing means remote from the gears with said point of high pressure intermediate the inlet and outlet means of the suction port delivering fluid to said bearing means ends, a recess in each end wall of the pump chamber connecting the bearing means along a line spaced from a center line through said bearing means toward the suction chamber and communicating with said suction chamber as the gears rotate, said recess defining with the teeth of the rotating gears a low pressure chamber receiving fluid from the fluid passage means through the bearing means into said recess whereby low pressure lubrication of the bearing means and trunnions is provided.

8 Claims, 8 Drawing Figures

METHODS AND APPARATUS FOR GEAR PUMP LUBRICATION

This invention relates to methods and apparatus for gear pump lubrication and particularly to gear pumps having means for lubricating the shafts with low pressure inlet fluid.

The lubrication of the shafts of gear pumps has long been recognized as a problem. In general, such lubrication has historically been based upon the use of high pressure fluid by-passed from the outlet side of the pump through the bearing. Many patents have proposed various structures for accomplishing this. Unfortunately, these high pressure lubricating systems have several undesirable qualities which are inherent in them. First, the oil is hotter by 20° F. to 25° F. than suction oil. Second, the high pressure feed of oil results in a loss in volumetric and thus overall efficiency in the pump. Third pump generated metal particles can be introduced into the bearing means with the high pressure oil. Avoiding any or all of these is desirable. These undesirable qualities can all be eliminated by using low pressure or suction oil for lubricating the bearings. Low pressure fluid has also been proposed for lubrication but only to a limited extent and has generally not met with favor. Typically of the structures proposed in the past for low pressure lubrication are Teruyama Pat. No. 4,090,820, Joyner Pat. No. 3,490,382 and Hodges et al. Pat. No. 3,447,472. In Teruyama, an axial groove is extended in the bore of each bushing from the inner end contacting the gear to the outer end. One end of this groove is connected to a chamber at the root of the gear which acts as a suction chamber. The other end of the groove is in communication with a hole extending along the casing. On rotation, the fluid in each tooth space is partially forced into and through the groove. In the case of Hodges and Joyner, there is provided grooving in the bore of each bushing which communicates with a side face of the gear rotor in a zone where the spaces between the rotating teeth are increasing in volume, the suction thus created inducing liquid to flow through the grooves. The problem with the latter Hodges and Joyner patents is that at low speed there is insufficient flow of liquid to provide adequate lubrication. In the case of Teruyama, on the other hand, there is a loss of efficiency as a result of fluid being drawn out of each rotating tooth space at chamber 55.

We have invented a new gear pump structure utilizing low pressure fluid which eliminates all of these problems of prior art lubricating structures. It provides a gear pump lubricated with low pressure fluid which is operative at all pressure levels and pump speeds and without any loss in efficiency in operation.

We provide a gear pump comprising a housing having a pump chamber, a suction chamber and a high pressure discharge chamber communicating with said pump chamber on opposite sides, a pair of meshing gears mounted for rotation in said pump chamber between said suction and discharge chambers, two axially spaced trunnions on opposite sides of each gear, bearing means surrounding each trunnion, said bearing means mounted in said housing a generally right-angled main suction port in said housing delivering fluid to said suction chamber around a substantially right-angled turn, a passage in the housing from the apex of the bend in the suction port to the bearing means at the end of each trunnion remote from the meshing gears, open conduit means on the housing connecting the ends of the bearing means adjacent the meshing gears and opening to said gears at the point of maximum suction between the gear teeth. Preferably, the housings are provided with floating end wear plates adjacent the meshing gears which wear plates carry the open conduit means. Preferably, open conduit means is slot in the end plates between the ends of the housings adjacent the meshing gears. The gears and trunnions preferably have an axial passage communicating between the ends of the bearing means remote from the meshing gears at each end and carrying fluid therebetween. Preferably, a flow restricting means in the form of a small clearance piece on the floating end plates is provided between the suction chamber and the point of maximum suction between the gear teeth.

In the foregoing general description of this invention, we have set out certain objects, purposes and advantages of our invention. Other objects, purposes and advantages of this invention will be apparent from a consideration of the following description and the accompanying drawings in which.

Figure 1:
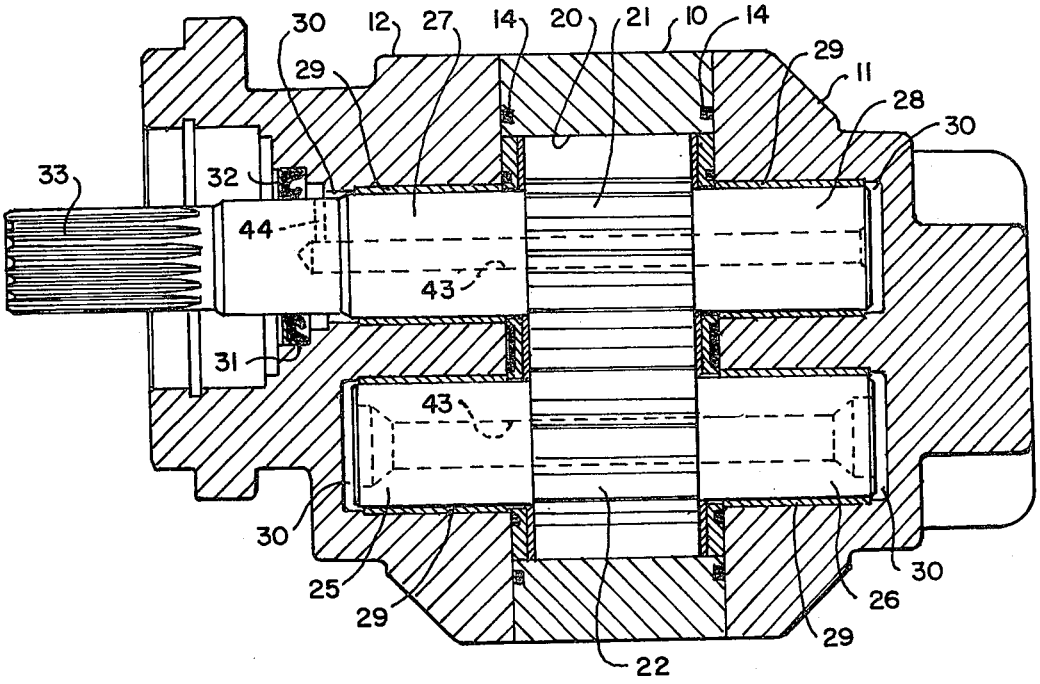
FIG. 1 is a vertical section through a typical gear pump according to this invention.
Figure 2:
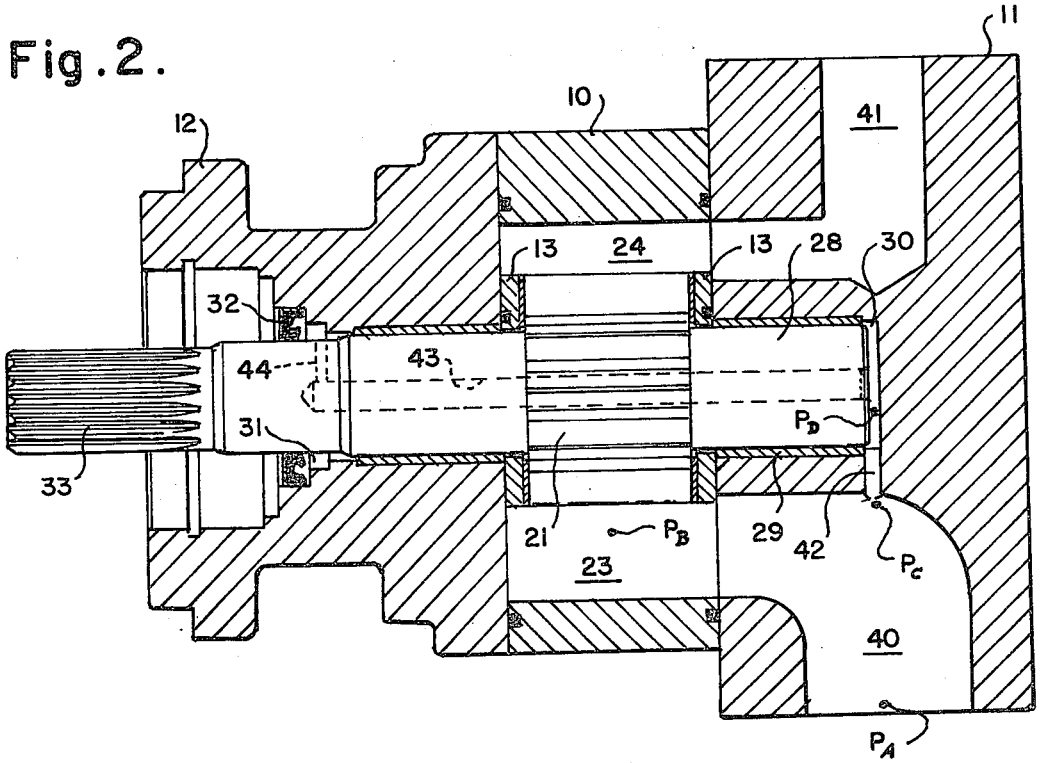
FIG. 2 is a horizontal section on the line II—II of FIG. 1, showing the driven gear and trunnions in elevation.
Figure 3:
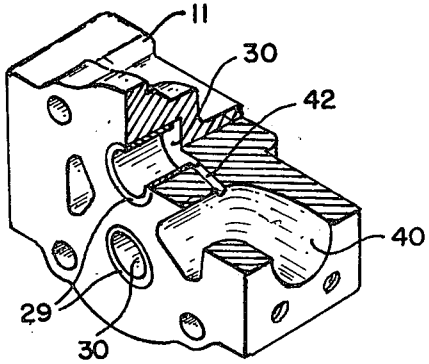
FIG. 3 is an isometric view of the port end plate of the pump of FIGS. 1 and 2 partly cut away.

Referring to the drawings, we have illustrated a gear pump having a housing made up of a gear body 10, a port end cover 11, a shaft end cover 12, end plates 13 at each end cover and seal rings 14 between each end cover 11, 12 and the gear body 10. The gear body is provided ith a pump chamber 20 carrying the meshing gears 21 and 22, suction chamber 23 and a discharge chamber 24. Each of gears 21 and 22 is provided with integral coaxial trunnions 25, 26, 27 and 28 mounted for rotation in bushings 29 or other bearing means in bearing carrier wells 30 in each of the end covers 11 and 12. One trunnion 27 is extended through a passage 31 and seal 32 in shaft end cover 12 and is provided with a splined drive shaft end 33. The housing assembly is held together by through bolts 34.

The port end cover 11 is provided with a right-angled (90° ) suction port 40 on one side communicating with the suction chamber 23 and a right-angled discharge port 41 communicating with discharge chamber 24 on the opposite side. Suction port 40 communicates through a passage 42 with the ends of well 30 beyond bushings 29 in the port end cover 11 remote from gears 21 and 22. This passage delivers fluid into the well 30. Each of the trunnions 25, 26, 27 and 28 and integral gears 21 and 22 has an axial bore 43 extending from end to end to discharge into wells 30 in drive end cover 12. In the case of trunnion 27, this is accomplished by providing a transverse radial passage 44 at the end of the bearing on the trunnion, communicating between bore 43 and well 30.

Each end plate 13 is provided with a slot 45 extending between the ends of bushings 29 within the end plate 13 and opening to the area of maximum suction 50 between the separating gear teeth of gears 21 and 22 during pumping.

The operation of the pump of this invention is as follows. Suction port 40 is connected to a reservoir of fluid (not shown) in the usual manner. When splined shaft 33 is rotated by a prime mover (not shown), it drives gear 21, which in turn drives gear 22 by their intermeshing teeth. The separation of the teeth at suction chamber 23 creates a suction or void causing fluid at a higher pressure, e.g., atmospheric pressure, to enter suction port 40. The fluid entering port 40 makes a 90° turn and passes into suction chamber 23 of the gear housing where it is picked up by the gear teeth and carried to the discharge chamber 24 and discharge port 41. The fluid entering port 40 is usually at atmospheric pressure, designated here as $P_A$. The pressure in suction chamber 23, designates $P_B$ is less than $P_A$ because of the frictional losses and particularly the losses induced by the 90° bend. The pressure, designated $P_C$, at the curve of port 40 and downstream from $P_A$ is greater than either $P_A$ or $P_B$ because of the momentum of the fluid and the flow resistance at the bend. As a result, the pressure of fluid in passage 42 is higher than the pressure $P_B$ in suction chamber 23, as is the pressure, designated $P_D$ in well 30 As a consequence, fluid flows through axial bores 43 to the opposite end wells 30 in drive end cover 12. This provides a higher absolute pressure of fluid at the ends of the wells 30 remote from gears 21 and 22.

Figure 4A:
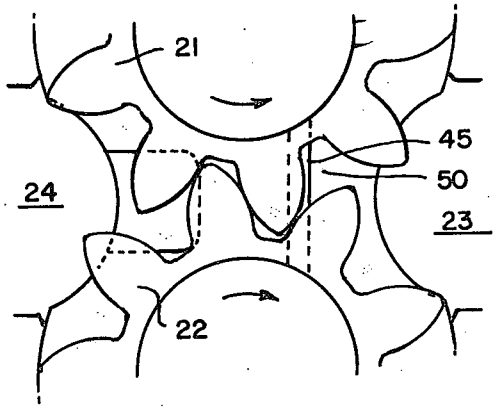
FIGS. 4A–4D are schematic views of the sequence of gear teeth motion during pumping of the pump of FIGS. 1 and 2.
Figure 4B:
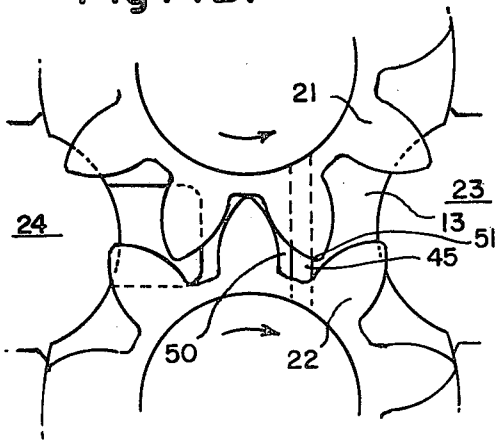
Figure 4C:
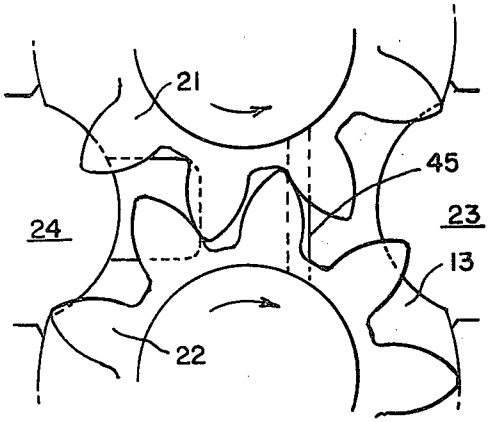
Figure 4D:
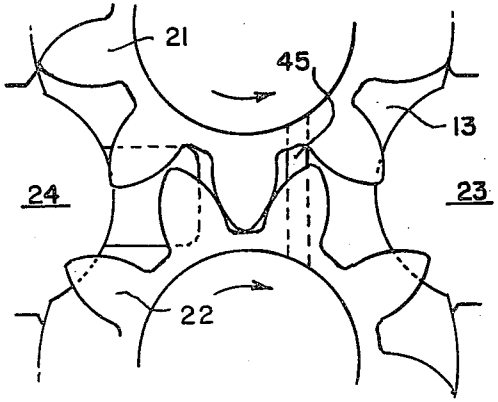
Figure 5:
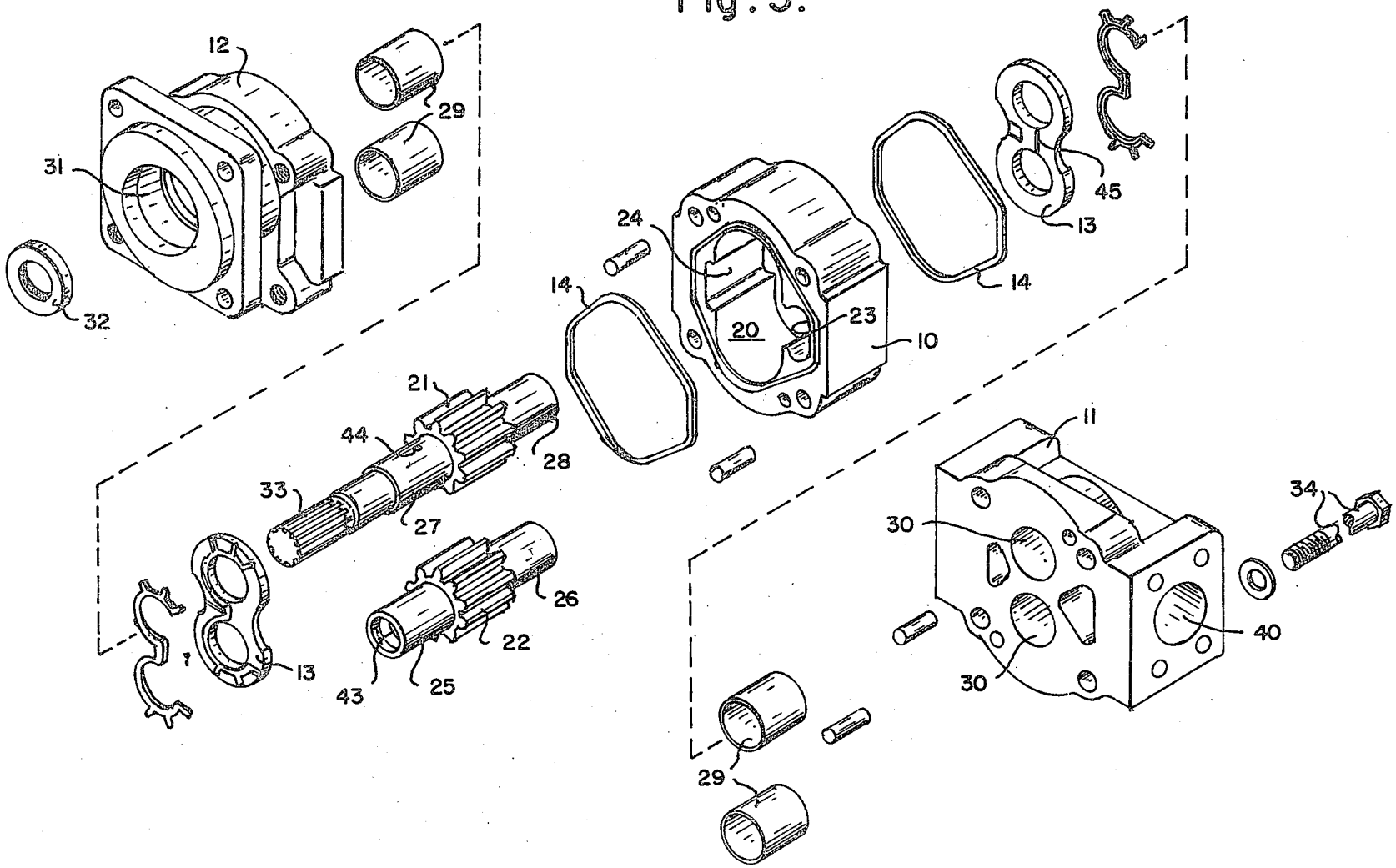
FIG. 5 is an exploded view of the pump of FIGS. 1 and 2.

Referring to FIG. 4, it will be seen that as the gears come out of mesh on the suction side, there are created rapidly increasing voids in certain tooth spaces. These voids create a sharp decrease in the absolute pressure. This decrease in pressure is communicated by slot 45 to the bushing ends adjacent the gears creating a substantial pressure differential between the pressure $P_D$ and the void area 50 between the teeth. This differential in pressure causes a flow of fluid through the clearance between the bushings 29 and trunnions 25, 26, 27 and 28. The flow of fluid from the suction chamber 23 into area 50 is retarded by small clearance 51.

In the foregoing specification, we have set out certain preferred practices and embodiments of this invention; however, it will be understood that this invention may be otherwise embodied within the scope of the following claims.

We claim:

1. A method of lubricating the trunnions and bearings of a gear pump comprising the steps of:

a. rotating the gears of the pump so as to create a vacuum at the area of tooth disengagement of said gears, b. introducing fluid to the gears of said pump through a suction port having spaced inlet and outlet means and being in the form of an angle between its inlet and outlet means whereby the apex of the angle has a pressure higher than the pressure at either of said suction port inlet and outlet means, c. introducing fluid to the bearing ends of the trunnions at one end of said pump from said point of high pressure intermediate the inlet and outlet means of said suction port, passing fluid through passage means extending through said gears and trunnions to the other bearing ends of the trunnions on the other side of the gears whereby fluid is delivered to the bearings on opposite sides of the gears, and d. drawing fluid through said bearings to the area of tooth disengagement by the vacuum at said area.

2. In a gear pump, a combination comprising a housing having a pump chamber, a suction chamber and a discharge chamber communicating with said pump chamber on opposite sides thereof, a suction port and a discharge port in said housing communicating respectively with the suction chamber and discharge chamber, each of said ports have spaced apart inlet and outlet means, said suction port being in the form of an angle between its inlet and outlet whereby the apex of the angle has a pressure higher than the pressure at either of said suction port inlet and outlet means, at least one pair of meshing gears mounted for rotation in said pump chamber, each gear having two axially spaced trunnions forming a part thereof, a plurality of bearing means in said housing each having an axial bore mounting said trunnions at each end for rotation of said gears in the pump chamber, drive means for rotating said gears so that liquid which is drawn through the suction port into the suction chamber is engaged by teeth on said gears and transferred to the discharge port under pressure, first fluid lubricant passage means connecting the bearing ends of the trunnions at one end on one side of the gears with said point of high pressure intermediate the inlet and outlet means of the suction port delivering fluid from the suction port to said bearing ends, second fluid passage means extending through said gears and trunnions to the other bearing ends of said trunnions on the other side of the gears and delivering lubricant thereto, said first and second passage means delivering fluid to the bearings on opposite sides of the gears and to a recess in each end wall of the pump chamber connecting the bearing means around each trunnion along a line spaced from a center line through said bearing means toward the suction chamber and communicating with said suction chamber as the gears rotate, said recess defining with the teeth of the rotation gears, a low pressure chamber receiving fluid from the fluid lubricant passage means through the bearing means into said recess whereby low pressure lubrication of the bearing means and trunnions is provided.

3. A gear pump combination as claimed in claim 1 wherein the suction and discharge ports are in the form of a substantially 90° passage.

4. A gear pump combination as claimed in claim 3 wherein the point intermediate the inlet and outlet means of the suction port having a higher pressure is the apex of the 90° passage.

5. A gear pump combination as claimed in claim 2 or 3 or 4 wherein the trunnions and gears have an axial passage extending through their length and connecting together the ends of the bearing means remote from the gears.

6. A gear pump combination as claimed in claim 2 or 3 or 4 wherein floating end plates are provided in the pump chamber at each end of the gears, said end plates carrying the recess in the end walls of the chamber connecting said bearing means.

7. A gear pump combination as claimed in claim 6 wherein a clearance member is provided on said end plates between the recess and the suction chamber.

8. A gear pump combination as claimed in claim 2 or 3 or 4 wherein the drive means drivingly engages a spline on one trunnion at one end of said housing and said suction and discharge ports are in the opposite end of said housing with said fluid passage means including a passage from the suction port to the bearing means in said other end of said housing.

* * * * *